US008132877B2

(12) United States Patent
Gold et al.

(10) Patent No.: US 8,132,877 B2
(45) Date of Patent: Mar. 13, 2012

(54) USER ADAPTABLE INK STATUS CONVEYANCE SYSTEM

(75) Inventors: Christopher Ryan Gold, Tigard, OR (US); Ernest Israel Esplin, Sheridan, OR (US); Frederck T. Mattern, Portland, OR (US); Brent Rodney Jones, Sherwood, OR (US); Michael A. Fairchild, Vancouver, WA (US)

(73) Assignee: Xerox Corporation, Norwalk, CT (US)

( * ) Notice: Subject to any disclaimer, the term of this patent is extended or adjusted under 35 U.S.C. 154(b) by 895 days.

(21) Appl. No.: 12/183,101

(22) Filed: Jul. 31, 2008

(65) Prior Publication Data

US 2010/0026741 A1 Feb. 4, 2010

(51) Int. Cl.
*B41J 2/195* (2006.01)

(52) U.S. Cl. ..... 347/7; 347/5; 347/6; 347/84; 347/85; 347/86; 347/87; 347/88

(58) Field of Classification Search ..... 347/5–7, 347/84–88
See application file for complete search history.

(56) References Cited

U.S. PATENT DOCUMENTS 5,223,860 A * 6/1993 Loofbourow et al. ..... 347/88
5,442,387 A * 8/1995 Loofbourow et al. ..... 347/88
6,494,553 B1 12/2002 Donahue et al.
6,748,183 B2 6/2004 Edmonds
7,104,635 B2 9/2006 Jones
7,296,882 B2 11/2007 Buehler et al.
2005/0140705 A1 * 6/2005 Godil et al. ..... 347/7
2006/0221156 A1 * 10/2006 Calamita et al. ..... 347/88

FOREIGN PATENT DOCUMENTS

JP 2005231098 A * 9/2005

* cited by examiner

*Primary Examiner* — Ryan Lepisto
*Assistant Examiner* — Guy Anderson
(74) *Attorney, Agent, or Firm* — Maginot, Moore & Beck, LLP

(57) ABSTRACT

An ink status conveyance system comprises a maximum monitored ink level sensor operable with respect to an ink source for holding a supply of ink and delivering the ink to a printhead. The ink level sensor is configured to detect when an available amount of ink in the ink source corresponds to an ample ink level. A notification controller is configured to track the available amount of ink in the ink source between an ample ink level and an ink out level. A user interface is configured to enable a user to designate a low ink notification set point for the ink source at any ink level between the ample ink level and the ink out level. The notification controller is configured to compare the user designated low ink notification set point to the available ink volume value to generate a low ink notification when the available ink volume value corresponds to the user designated low ink notification set point.

9 Claims, 7 Drawing Sheets

USER ADAPTABLE INK STATUS CONVEYANCE SYSTEM

TECHNICAL FIELD

This disclosure relates generally to ink jet printers, and in particular, to the ink supply controllers used in such ink jet printers.

BACKGROUND

A printhead assembly of an inkjet printer has a plurality of inkjets from which drops of ink are ejected towards the recording medium. A printer may have multiple print heads which are similar or may be identical. The inkjets of a printhead receive the ink from an ink manifold in the printhead which, in turn, receives ink from an ink supply source, such as a melted ink reservoir or an ink cartridge. Ink supply volume sensing is employed with various ink types and states. The largest volume of ink in a phase change ink device is typically in the solid state and is melted as needed. Each inkjet includes a channel having one end connected to the ink supply manifold. The other end of the ink channel has an orifice, or nozzle, for ejecting drops of ink. The inkjets may be formed in an aperture, or nozzle plate that has openings corresponding to the nozzles of the ink jets. During operation, firing signals excite actuators in the inkjets to expel drops of fluid from the inkjet nozzles onto the recording medium. By selectively exciting the actuators of the ink jets to eject drops as the recording medium and/or printhead assembly are moved relative to each other, the deposited drops can be precisely patterned to form particular text and graphic images on the recording medium.

Previously known systems typically were configured to detect or track the amount of ink available for delivery to the printhead(s). For example, in some previously known phase change ink systems, when the amount of remaining ink in the ink supply source, typically in the solid state, becomes equal to or less than a predetermined "low ink" set point, a "low ink" notification is generated that alerts a user to the low ink status so that the user may take appropriate action such as replenishing the ink supply and/or ordering new quantities of ink. Printing operations may typically continue after a low ink notification is generated. When most or substantially all of the deliverable ink has been depleted, an "ink out" notification is generated to alert the user that ink is no longer available for one or more printheads.

In previously known systems, "ink low" and "ink out" set points are typically predetermined by sensor placement where low and out states correspond directly to the non adjustable sensor actuation point. A variant of the sensor actuation fixed transition point was to add a "volume consumption" delay prior to issuing notification of a low or out condition. This fixed value was programmed into the print controller or stored in memory for access by the print controller during manufacture of the system. This situation does not provide flexibility in the number of images or prints that remain at the time the available ink volume reaches the predetermined "ink low" set point. For example, indicating an ink low status when there is a relatively large volume of ink remaining in an ink source may cause a user to replenish and/or purchase ink more often than is desired. Similarly, indicating an ink low status fairly close to the "ink out" set point may leave a user with an inadequate amount of time to replenish and/or purchase the ink before printing operations are halted. Large print jobs may have to be discontinued while replacement ink is obtained. In addition, the fixed, predetermined "low ink" set point may not be appropriate for customers that either print very little or that have high monthly print volumes.

SUMMARY

In order to provide flexibility as to when ink level notifications are generated, an ink status conveyance system has been developed that allows a printer operator to select or designate low ink notification set points at which low ink notifications are generated. In particular, the ink status conveyance system comprises an ink level sensor operable with respect to an ink source that is configured to hold a supply of ink and to deliver ink to a printhead. The ink level sensor is configured to generate a signal in response to an available amount of ink in the ink source corresponding to an ample ink level. The system includes a user interface configured to enable a user to designate a low ink notification set point for use with the ink source, and a notification controller coupled to an ink level sensor to receive the signal from the ink level sensor and coupled to the user interface to receive the user designated low ink notification set point from the user interface. The notification controller is configured to determine an available ink volume in the ink source between the ample ink level and an ink out level and to compare the user designated low ink notification set point to the available ink volume. The notification controller is configured to generate a low ink signal when the available ink volume value corresponds to the user designated low ink notification set point.

In another embodiment, an ink jet imaging device is provided. The ink jet imaging device includes a printhead configured to eject melted phase change ink onto an image receiver; and an ink source configured to hold a supply of solid phase change ink for the printhead and to deliver the solid phase change ink to an ink melter for melting the solid phase change ink and delivering the melted phase change ink to the printhead. An ink level sensor is operably positioned with respect to an ink source that is configured to hold a supply of ink and to deliver ink to a printhead. The ink level sensor is configured to generate a signal in response to an available amount of ink in the ink source corresponding to an ample ink level. The system includes a user interface configured to enable a user to designate a low ink notification set point for use with the ink source, and a notification controller coupled to the ink level sensor to receive the signal from the ink level sensor and coupled to the user interface to receive the user designated low ink notification set point from the user interface. The notification controller is configured to determine an available ink volume in the ink source between the ample ink level and an ink out level and to compare the user designated low ink notification set point to the available ink volume. The notification controller is configured to generate a low ink signal when the available ink volume value corresponds to the user designated low ink notification set point.

BRIEF DESCRIPTION OF THE DRAWINGS

The features for enabling a printer user to select an ink low volume at which an ink low notification is delivered to the user are explained in the following description, taken in connection with the accompanying drawings, wherein.

DETAILED DESCRIPTION

Figure 1:
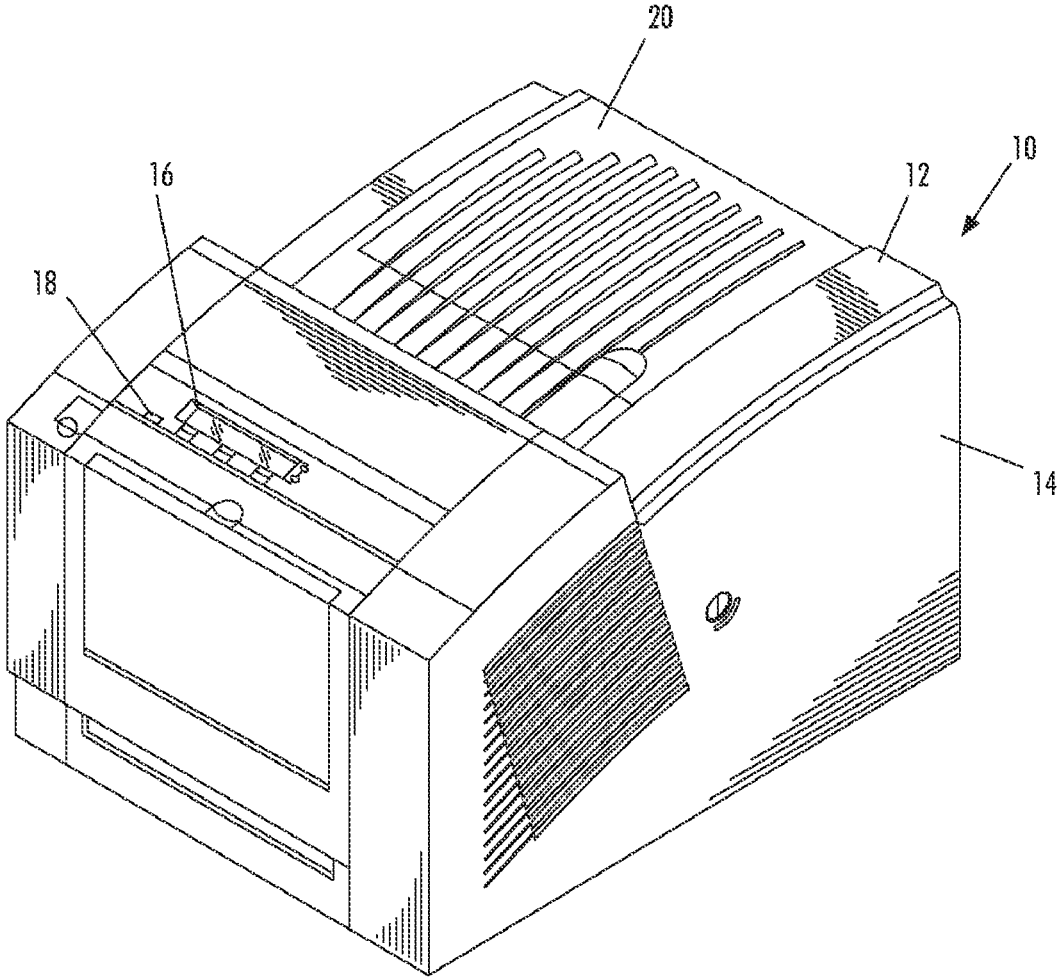
FIG. 1 is a perspective view of a phase change printer with the printer ink access cover closed.

For a general understanding of the present embodiments, reference is made to the drawings. In the drawings, like reference numerals have been used throughout to designate like elements.

As used herein, the term "imaging device" generally refers to a device for applying an image to print media. "Print media" or "recording media" can be a physical sheet of paper, plastic, or other suitable physical print media substrate for images, whether precut or web fed. The imaging device may include a variety of other components, such as finishers, paper feeders, and the like, and may have various embodiments, such as a copier, printer, or a multifunction machine. A "print job" or "document" is normally one or a set of related sheets printed or copied on the imaging device. An image generally includes information in electronic form which is to be rendered on the print media by the marking engine and may include text, graphics, pictures, and the like.

FIG. 1 shows a solid ink phase change ink imaging device 10 that includes an outer housing having a top surface 12 and side surfaces 14. A user interface, such as a front panel display screen 16, displays information concerning the status of the printer, and user instructions. Buttons 18 or other control elements for controlling operation of the printer are adjacent the user interface display screen, or may be at other locations on the printer. An ink jet printing mechanism 11 (FIG. 6) is contained inside the housing. An ink delivery system delivers ink to the printing mechanism. The ink delivery system is contained under the top surface of the printer housing. The top surface of the housing includes a hinged ink access cover 20 that opens, as shown in FIG. 2, to provide the user access to the ink delivery system.

In the exemplary printer shown, the ink access cover 20 is attached to an ink load linkage element 22 so that when the printer ink access cover 20 is raised, the ink load linkage 22 slides and pivots to an ink load position. As seen in FIG. 2, opening the ink access cover reveals a key plate 26 having keyed openings 24A, 24B, 24C, 24D. Each keyed opening 24A, 24B, 24C, 24D provides access to an insertion end of one of several individual feed channels 28A, 28B, 28C, 28D of the solid ink delivery system (see FIGS. 3, 4 and 5). Each feed channel 28A, 28B, 28C, 28D delivers ink sticks 30 of one particular color to a corresponding melter, such as a melt element or melt plate 32A, 32B, 32C, 32D.

Figure 6:
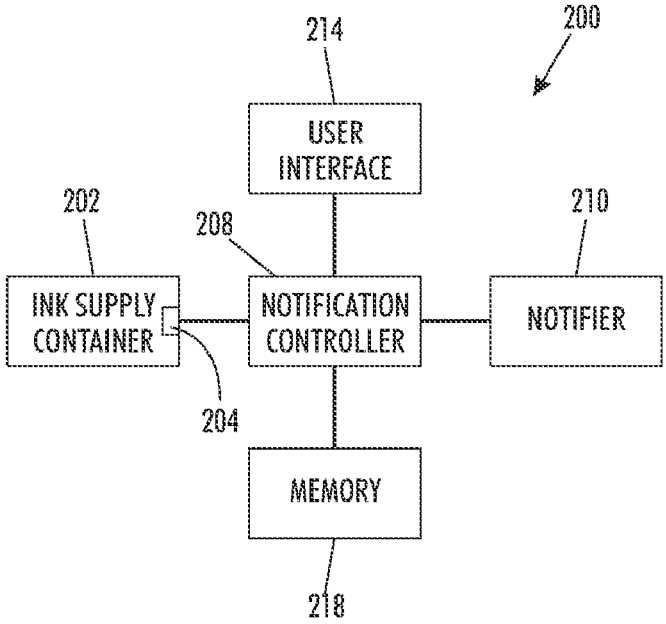
FIG. 6 is a schematic block diagram of an embodiment of a user adaptable ink status conveyance system.

Each feed channel defines a feed path from the insertion end of the feed channel to the melt end of the feed channel adjacent the melt plate The melt plate melts the solid ink stick into a liquid form. The melted ink flows along the face of the melt plate and drips through a gap 33 between the melt end of the feed channel and the melt plate (FIG. 3), and into a corresponding liquid ink reservoir 31A, 31B, 31C, 31D (FIG. 6). Each reservoir corresponds to one of the melt plates 32A, 32B, 32C, 32D, which in turn corresponds to one of the ink stick feed channels 28A, 28B, 28C, 28D.

Figure 2:
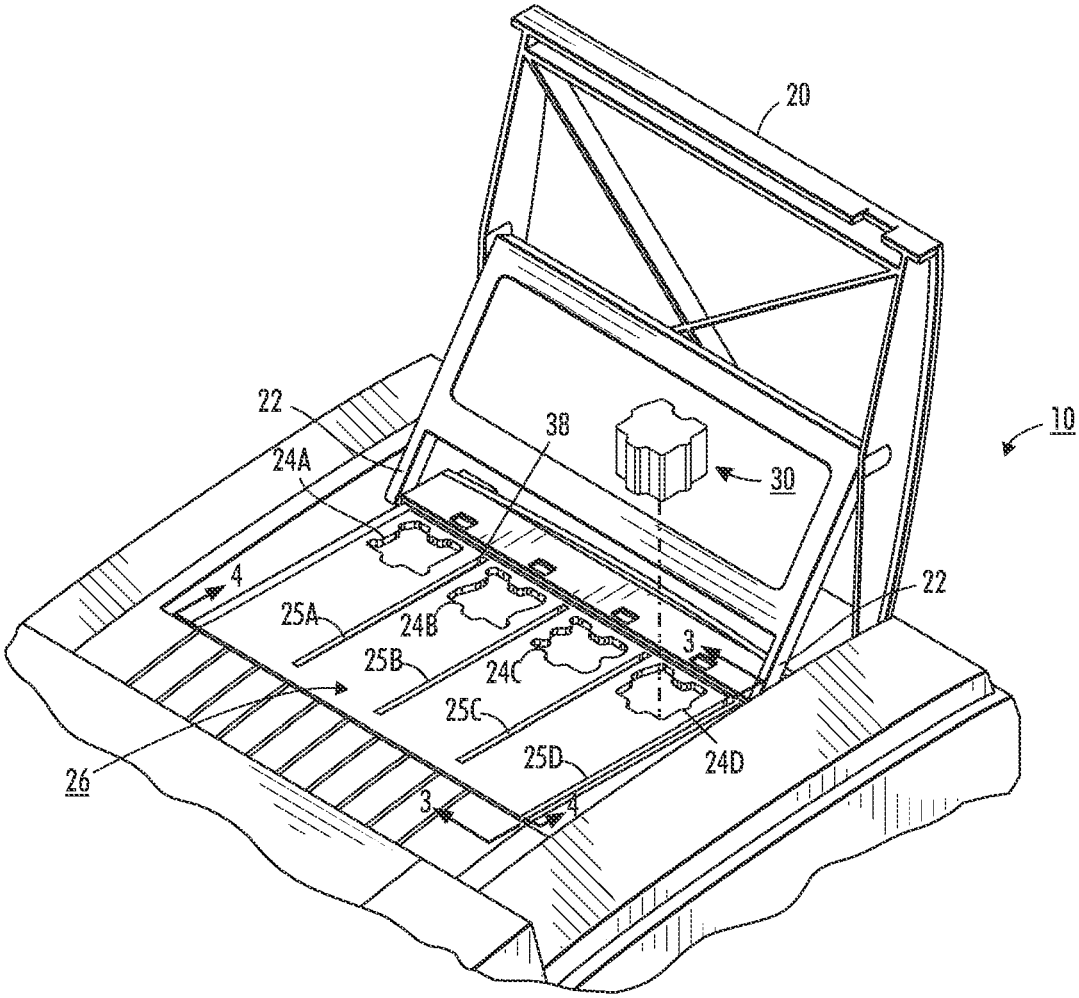
FIG. 2 is an enlarged partial top perspective view of the phase change printer with the ink access cover open, showing a solid ink stick in position to be loaded into a feed channel.
Figure 3:
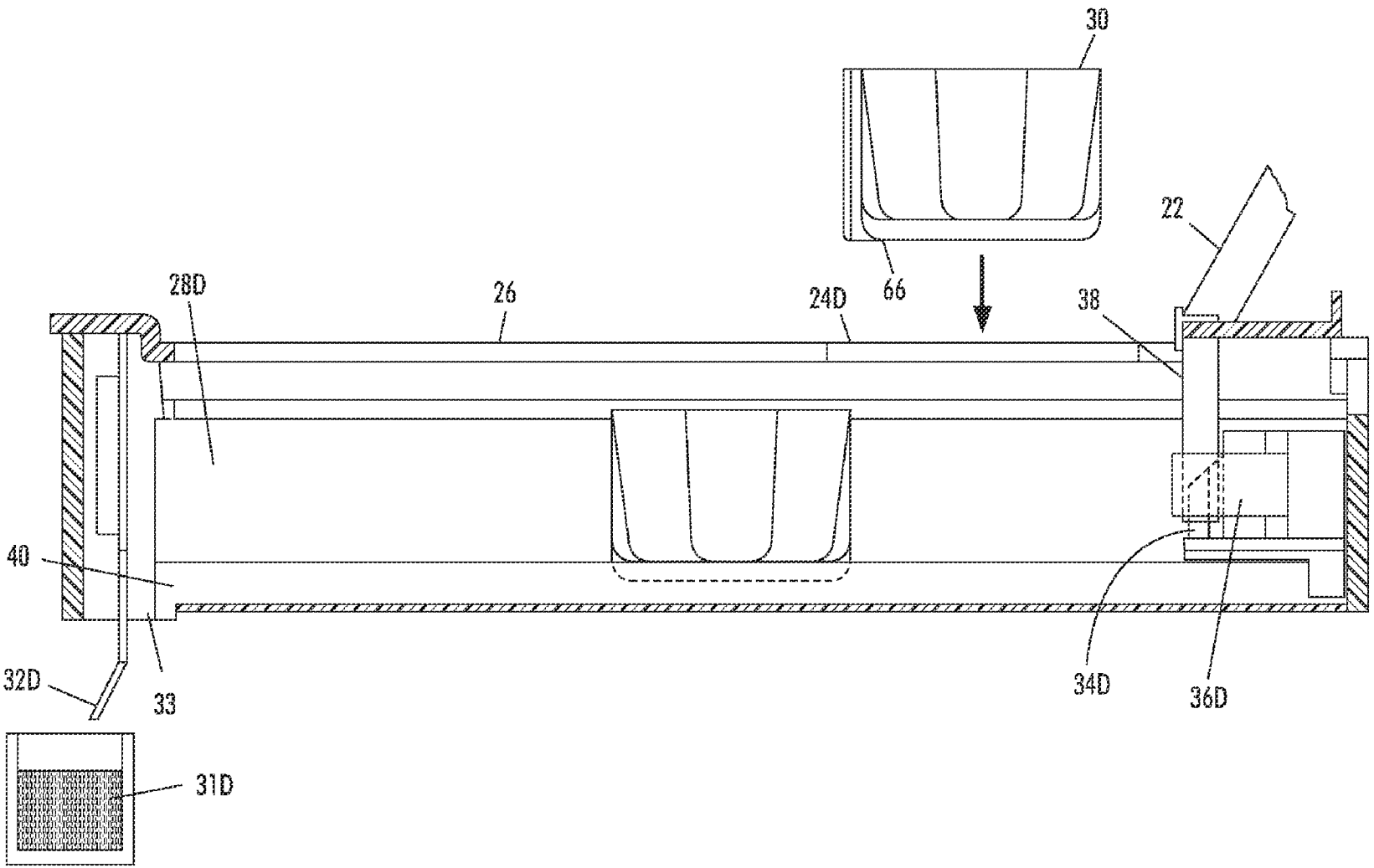
FIG. 3 is a side sectional view of one embodiment of a feed channel of a solid ink feed system, taken along line 3-3 of FIG. 2.

Although the feed channels depicted in FIGS. 2 and 3 are substantially linear, feed channels 58 may have any suitable shape including linear and non-linear shapes in order to maximize the number of ink sticks that may be inserted into the feed channels. For example, the feed channels 58 may have linear and curved sections as needed to deliver respective ink sticks from the insertion end to the melt end. An arcuate portion of the feed channels may be short or may be a substantial portion of the path length. The full length of the channels may be arcuate and may consist of different or variable radii A linear portion of the feed channels may likewise be short or a substantial portion of the path length.

The solid ink sticks may be fed from the insertion area to the melt area in any suitable manner including by influence of gravity, spring force, or other urging device or driver through the ink feed system. In the embodiment of FIG. 3, the solid ink delivery system 48 includes a drive member 34 for moving one or more ink sticks 30 along the feed path in the respective feed channels. A separate drive member may be provided for each respective feed channel. The drive member may be used to transport the ink over all or a portion of the feed path and may provide support or guidance to the ink and may be the primary ink guide over all or a portion of the feed path.

In the embodiment of FIG. 3, the drive members comprise push blocks. In particular, each feed channel in the exemplary embodiment illustrated includes a push block 34A, 34B, 34C, 34D driven by a driving force or element, such as a constant force spring (36A, 36B, 36C, 36D), to conduct the individual ink sticks along the length of the longitudinal feed channel toward the melt plates that are at the melt end of each feed channel. The tension of the constant force spring drives the push block toward the melt end of the feed channel. The ink load linkage 22 is coupled to a yoke 38, which is attached to the constant force spring mounted in the push block. The attachment to the ink load linkage 22 moves the push blocks 34A, 34B, 34C, 34D toward the insertion end of the feed channel when the ink access cover 20 is raised to reveal the key plate 26. The constant force spring can be a flat spring which extends along the feed axis to apply force to the push blocks that urge the ink sticks toward the melt plates. Persons familiar with the art will identify that other orientations of the ink stick feed channel may be used, and that other techniques are available to move the ink sticks from the insertion end of the feed channel to the melt end.

A color printer may use four colors of ink (yellow, cyan, magenta, and black). Ink sticks 30 of each color are delivered through a corresponding individual one of the solid ink feed channels 28A, 28B, 28C, 28D. The key plate 26 has keyed openings 24A, 24B, 24C, 24D to aid the printer user in ensuring that only ink sticks of the proper color are inserted into each feed channel. Each keyed opening of the key plate has a unique shape. The ink sticks 30 of the color for that feed channel have a shape corresponding to the shape of the keyed opening. The keyed openings and corresponding ink stick shapes exclude from each ink feed channel ink sticks of all colors except the ink sticks of the proper color for that feed channel of that particular printer.

Figure 4:
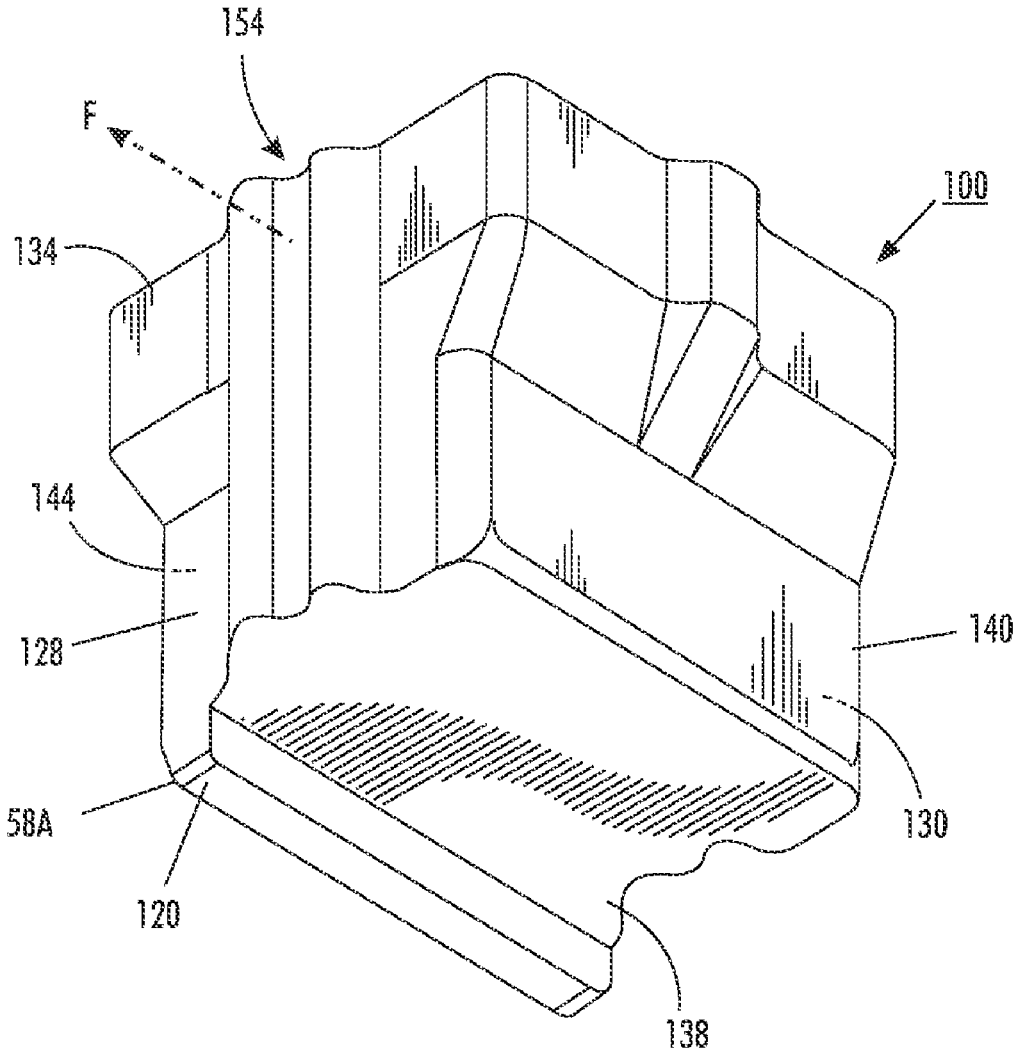
FIG. 4 is a perspective view of an exemplary ink stick for use in the imaging device of FIG. 1.

An ink stick may take many forms. One exemplary solid ink stick 100 for use in the ink delivery system is illustrated in FIG. 4. The ink stick has a bottom surface 138 and a top surface 134. The particular bottom surface 138 and top surface 134 illustrated are substantially parallel one another, although they can take on other contours and relative relationships. Moreover, the surfaces of the ink stick body need not be flat, nor need they be parallel or perpendicular one another. The ink stick body also has a plurality of side extremities, such as lateral side surfaces 140, 144 and end surfaces 128, 130. The side surfaces 140 and 144 are substantially parallel one another, and are substantially perpendicular to the top and bottom surfaces 134, 138. The end surfaces 128, 130 are also basically substantially parallel one another, and substantially perpendicular to the top and bottom surfaces, and to the lateral side surfaces. One of the end surfaces 128 is a leading end surface, and the other end surface 130 is a trailing end surface. The ink stick body may be formed by pour molding, injection molding, compression molding, or other known techniques.

Ink sticks may include a number of features that aid in correct loading, guidance, sensing and support of the ink stick when used. These loading features may comprise protrusions and/or indentations that are located in different positions on an ink stick for interacting with key elements, guides, supports, sensors, etc. located in complementary positions in the ink delivery system. An ink stick may have any suitable number and/or placement of loading (i.e. insertion and/or feeding) features. Some of these features may be substantially perpendicular to one another, substantially aligned or have any other relationship.

Loading features may be categorized as insertion features or feeding features. Insertion features such as exclusionary keying elements and orientation elements are configured to facilitate correct insertion of ink sticks into the loading station and, as such, are substantially aligned with the insertion direction of the loading station. For example, FIG. 4 shows an ink stick having an insertion keying feature 154 that is configured to interact with a complementarily shaped feature (not shown) in a keyed opening of the imaging device to allow insertion of the ink stick into the appropriate ink channel and to block insertion of ink sticks not having the appropriate configuration.

Feeding features, such as alignment and guide elements, aid in aligning and guiding ink sticks as they are moved along the feed channels to reduce the possibility of ink stick jams in the feed channel and to promote optimum engagement of the ink sticks with an ink melter in the ink melt assembly. Feeding features, therefore, may be substantially aligned with the feed direction of the ink delivery system in order to interact with ink stick guides and/or supports in the ink delivery system. With reference again to FIG. 4, the ink stick includes a guide element 120 formed in the ink stick body to interact or engage with guide members such as a guide track (not shown) in the appropriate feed channel. In an example, the first ink stick guide element 66 is laterally offset from the lateral center of gravity of the ink stick body. In this exemplary embodiment, the guide element 120 is adjacent one of the lateral sides 144 of the ink stick body in order to engage a guide track positioned in a complementary position in the feed channel.

Figure 5:
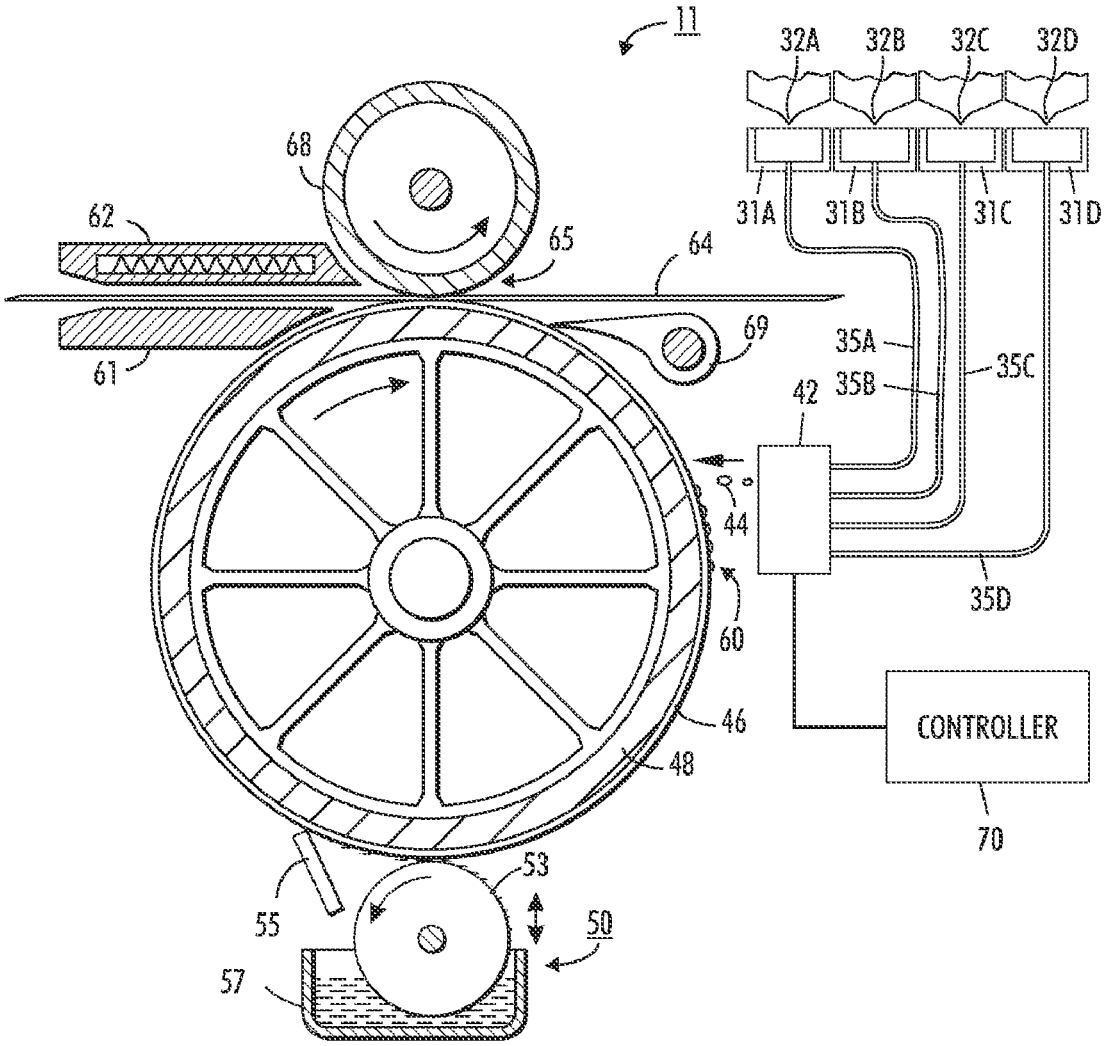
FIG. 5 is a schematic block diagram of an embodiment of an ink jet printing mechanism.

FIG. 5 is a schematic block diagram of an embodiment of an ink jet printing mechanism 11. The printing mechanism includes a printhead 42 that is appropriately supported for stationary or moving utilization to emit drops 44 of ink onto an intermediate transfer surface 46 applied to a supporting surface of a print drum 48. The ink is supplied from the ink reservoirs 31A, 31B, 31C, 31D of the ink supply system through integrated passages or, as shown in the illustration, through liquid ink conduits 35A, 35B, 35C, 35D that connect the ink reservoirs with the printhead 42. The intermediate transfer surface 46 can be a liquid layer such as a functional oil that can be applied by contact with an applicator such as a roller 53 of an applicator assembly 50. By way of illustrative example, the applicator assembly 50 can include a metering blade 55 and a reservoir 57. The applicator assembly 50 can be configured for selective engagement with the print drum 48.

The exemplary printing mechanism 11 further includes a substrate guide 61 and a media preheater 62 that guides a print media substrate 64, such as paper, through a nip 65 formed between opposing actuated surfaces of a roller 68 and the intermediate transfer surface 46 supported by the print drum 48. Stripper fingers or a stripper edge 69 can be movably mounted to assist in removing the print medium substrate 64 from the intermediate transfer surface 46 after an image 60 comprising deposited ink drops is transferred to the print medium substrate 64. In certain ink jet printers, the ink drop generators of the printhead may eject drops of ink directly onto a print media substrate, without using an intermediate transfer surface.

A print controller 70 is operatively connected to the printhead 42. The print controller transmits activation signals to the printhead to cause selected individual ink jets (drop generators, not shown) of the printhead to eject drops of ink 44. The activation signals energize the individual drop generators of the printhead. An exemplary printhead includes a multiplicity of such drop generators 72. The controller 70 selectively energizes the drop generators by providing a respective ejector activation signal to each drop generator. Each drop generator employs an ink drop ejector that responds to the ejector activation signal. Exemplary ink drop ejectors include piezoelectric transducers, and in particular, ceramic piezoelectric transducers although any suitable type of transducer may be used.

Operation of all of the exemplary systems described hereinabove may be accomplished by user interface control. The user interface 18 may be configured to display the available features and programming options, such as media trays, the type of media in each tray, the size of media in the trays, colors of ink or toner, and the like, and may be used to obtain the print job parameters for a print job. The user interface 18 is configured to enable a user to select and communicate job programming attributes to the print controller 70. In addition to selecting parameters for the print job, the user interface 18 may be used to set additional or alternate job attributes on a per-page basis for selected pages. For example, as explained below, the user interface may be configured to enable a user to select and/or modify ink level notification set points.

In order to avoid exhaustion of the ink supply in the feed channels, the imaging device includes a user adaptable ink status conveyance system that is configured to allow a user to select, designate, or otherwise identify one or more ink level notification set points at which user identifiable ink level notifications may be generated. As explained below, the user adaptable ink level notification system is configured to detect or determine when the ink level remaining in an ink supply source, such as a feed channel, reaches or falls below an ample or maximum monitored ink level and to track the ink level remaining in each feed channel within the monitored range between ample ink level and a minimum ink level, i.e., ink out condition. The ample level will be determined by the product manufacturer to be more ink than would prompt concern or need for attention but less than the full load capacity for a particular product. Since many users may never install a sufficient volume of ink to reach the full state, an ample amount of ink is intermediate a theoretical maximum load volume and the lesser highest volume that would prompt reorder or other attention. The notification system enables the selection or identification of set points corresponding to available ink volumes at which certain notifications, e.g., low ink level, are conveyed to the user.

Referring now to FIG. 6, there is depicted an embodiment of a user adaptable ink level notification system 200 that may be implemented in substantially any imaging device that includes an ink supply source or container 202 that holds and maintains a supply of ink for delivery to one or more printheads of an ink jet printer. For example, although the imaging device described above is a phase change ink imaging device, the user adaptable ink level notification system may be utilized in substantially any type of imaging device that uses substantially any type of ink or marking material including phase change ink in solid or liquid form, aqueous inks, gel inks, etc. Accordingly, the ink supply source or container 202 depicted in FIG. 6 may be any suitable container or device appropriate for the type of ink. For example, the ink supply container 202 may comprise an ink feed channel such as the ink channels described above for holding and delivering quantities of solid ink to the ink melter for subsequent delivery to a printhead. Alternatively, the ink supply container may comprise an ink tank configured to contain a quantity of liquid ink.

The exemplary user adaptable ink level notification system includes ink level sensors 204, a notification controller 208, an ink level notifier 210, a user interface 214, and a memory 218. As explained in more detail below, the notification controller 208 in conjunction with ink level sensors 204 is configured to monitor and track the available ink volume in an ink supply container between a maximum monitored ink level and an "ink out" level. In particular, the ink level sensor 204 is configured to detect when the available volume of ink in an ink supply container reaches or passes below a maximum monitored ink level. The ink level sensor may be any suitable type of sensor or detector that is appropriate for use with the particular type of ink container or type of ink utilized in the imaging device. For example, in the case of solid ink, the ink level sensor may comprise a sensor or detector configured to detect solid ink sticks as they pass a predetermined point in a feed channel corresponding to the maximum monitored, or ample, ink level. As explained below, ink level sensors in feed channels may be configured to optically or mechanically detect ink sticks as they pass. In the case of liquid ink, the ink level sensor may be any suitable sensor or detector configured to optically or mechanically detect when the liquid ink in the ink container, i.e., ink tank, has passed below a threshold level or threshold volume in the tank corresponding to the maximum monitored, or ample, ink level. Whatever the form of the ink level sensor, the sensor is configured to generate an output, e.g. an ink level signal, when the ink volume remaining in the ink supply container, e.g., ink channel or ink tank, reaches or falls below the maximum monitored ink level.

The maximum monitored ink level may be any suitable level that permits a wide range of selectable "low ink" levels at which "low ink" notifications may be generated before an "ink out" status is reached for a given feed channel. For example, in one embodiment, the maximum monitored ink level may permit the printing of approximately 2000 or more "standard" or "average" pages based on predetermined ink per page values or ink per page running or periodic averages. Alternative selection types may be provided in addition to number of pages. As example, the number of days or weeks of average usage that would remain when ink reached a particular volume level. The adjustable or user selectable "ink low" state relative to the "ink out" status is a significant benefit of the current concept. Setting flexibility may be applied to the "ink out" status as well. Usability of all available ink as the "ink out" state is attained, described in more detail below, would generally be the goal and an alternative need not be offered the user, however, this concept also encompasses a selectable "ink out" state which would declare ink to be out at a desired greater level of remaining ink volume. This capability might provide a reserve volume that would not generally be available without a setting change or temporary override. Such a feature might be made available to only select users as a precaution against an ink out inoperable state where printer productivity is crucial. Further descriptions of a settable "ink low" state would generally apply to an adjustable "ink out" state as well.

The notification controller 208 is configured to track ink consumption from the maximum monitored ink level to an "ink out" level at which point most or substantially all of the available ink in an ink channel 28 has been depleted. In one embodiment, the notification controller 208 is configured to receive the ink level sensor outputs indicating that an ink source or ink sources has reached the maximum monitored ink level at which point the notification controller is configured to set an available ink volume for a particular ink source to the designated maximum monitored ink level and to monitor the available ink volume in the particular ink source until the ink out level is reached. Monitored available ink volumes may be stored in memory 218 by the controller. Estimates or measures of ink stick consumption and ink stick insertions may be subtracted from or added to the available ink volume values stored in memory. The available ink volumes for the ink feed channels may be stored in the memory 218 in any suitable form, such as a determined or actual amount of available ink, an estimate of the number of pages or prints which can be printed before the available ink is depleted, an approximate number of full or partial ink sticks remaining in the ink channels, etc.

When the monitored available ink volumes indicate that most or substantially all of the available ink in an ink channel has been depleted, the ink channel 28 is considered to have reached in an "ink out" status or condition. When an ink channel reaches an "ink out" status, the notification controller 208 generates an "ink out" signal. The print controller 70 is configured to receive the "ink out" signal and to respond accordingly by, for example, halting print operations or preventing print operations using depleted ink channels until an appropriate amount of ink has been added to the channels. In addition, the ink level notifier 210 is configured to receive the "ink out" signal and to convey user identifiable "ink out" notifications to the printer operator. For example, the ink level notifier 210 may be configured to energize an indicator such as a light emitting device or a sound emitting device that indicates an "ink out" condition for one or more of the ink channels. Alternatively or additionally, "ink out" notifications may be displayed on a display panel in the form of text or graphics indicating the "ink out" condition for one or more of the ink channels.

The notification controller is configured to generate "low ink" signals at one or more points prior to an ink channel reaching the "ink out" state so that the user may take appropriate action such as replenishing the ink supply and/or ordering new quantities of ink before printing has to be stopped or paused due to the "ink out" state. An automatic reorder process, if implemented, may also be initiated when the "low ink" status is attained. An example of one multi "low ink" scenario would be an earlier notification for automatic reorder and a later "low ink" indication by control panel message or other means that a user would notice. Accordingly, the notification controller 208 is configured to compare the monitored available ink levels for the ink channels with "low ink" notification set points and to generate "low ink" signals when the comparison indicates that the available ink volume in a feed channel reaches or falls below the "low ink" notification set points. Similar to an "ink out" condition, the ink level notifier 210 is configured to receive the "low ink" signals from the notification controller and to generate "low ink" notifications that alert a user to the low ink status so that the user may take appropriate action such as replenishing the ink supply and/or ordering new quantities of ink.

The notification controller 208 may be programmed or have access to default "low ink" notification set points. The notification controller is configured to compare the monitored available ink levels for the ink channels to the default "low ink" notification set points and to generate "low ink" signals when the comparison indicates that the available ink volume in a feed channel reaches or falls below the default "low ink" notification set points. Default "ink low" notification set points are predetermined and preprogrammed into the notification controller or stored in memory for access by the notification controller during manufacture of the system. The default "ink low" set point may vary by color. In one embodiment, default notification set points are stored in the memory 218. The memory 218 may include designated areas for each ink channel at which default notification set points are stored. The memory may be any suitable type of memory, such as non-volatile read only memory (ROM) or a programmable non-volatile memory such as an EEPROM or flash memory. In addition, default notification set points may be stored in the memory in any suitable form, such as a determined or actual amount of available ink, an estimate of the number of pages or prints which can be printed before the available ink is depleted, an approximate number of full or partial ink sticks remaining in the ink channels, etc. In one embodiment, default "ink low" set points correspond to available ink volumes that permit approximately 250 to 500 pages to be printed once the default set point has been reached although any suitable ink volume or approximate number of "average" prints that can be printed may be used.

In order to provide flexibility to a printer operator as to when a "low ink" notification is generated, the user adaptable ink status conveyance system is configured to enable a printer operator to adjust, modify, or override the default "low ink" notification set points so that ink level notifications may be tailored or optimized to suit the particular needs or preferences of printer operators or types of print jobs. In the embodiment of FIG. 6, the user adaptable ink status conveyance system includes a user interface 214 that is configured to enable user selection or input of "low ink" notification set points at which notifications are generated.

The user interface 214 may be any suitable device or utilize any suitable method for enabling user selection or identification of "low ink" notification set points. The user interface may be menu driven, command driven, etc. and may incorporate or utilize various folders, windows, icons, etc. The user interface 18 may be implemented via a touch sensitive liquid crystal display (LCD), a control panel including a keypad and display device combination, a graphical user interface (GUI) or other type of user interface as is known in the art. In one embodiment, the user interface for the notification system may be incorporated into the user interface of the imaging device. The user interface, however, may be remote from the imaging device and be in communication with the imaging device over a suitable communication link or network such as the world wide web or a local area network. User selection of a "low ink" notification set point may be restricted by password or other restrictive method.

Printer operators may designate "low ink" notification set points for each ink feed channel individually or may designate a universal "low ink" notification set point that is applicable to each ink feed channel. User selected ink level notification set points may input via the user interface in any suitable form that is capable of conveying meaning to the notification controller as to when an ink level notification should be generated. For example, in one embodiment, user selected ink level notification set points may correspond to the number of pages or prints that are capable of being printed using a particular ink channel when the ink channel reaches an "ink low" status. Alternatively, user selected "low ink" notification set points may correspond to grams of ink or percentage of ink volume remaining in an ink channel relative to a particular point, e.g., full ink channel level or maximum monitored ink level. In yet another embodiment, user selected "low ink" notification set points may correspond to a number of full or partial ink sticks that are remaining when an ink channel reaches an "ink low" status.

The notification controller is operably coupled to the user interface over a suitable communication link in order to receive the user selected ink level notification set points. The notification controller is configured to store the user selected set points in association with the respective ink feed channel with which it is to be used. User selected "low ink" notification set points may be stored in the memory. As is known in the art, depending on the format of the user selected "low ink" notification set points, the notification controller may be configured to translate or convert the user selected "low ink" notification set points into forms that are usable for comparison with the monitored available ink volume values.

As mentioned above, the notification controller 208 is configured to compare the monitored available ink levels for the ink channels with the user selected "low ink" notification set points or to the default "low ink" notification set points if no user selected set points have been designated. When the comparison indicates that the available ink volume in a feed channel reaches or falls below the user selected or default "low ink" notification set points, the notification controller is configured to generate or output a "low ink" signal to the ink level notifier.

The ink level notifier 210 is configured to generate a user identifiable "low ink" notification in response to the "low ink" signal generated by the notification controller. The ink level notifier 210 may be configured to generate any suitable type of "low ink" notification. For example, "low ink" notifications may include any type of textual, audio and/or video notification capable of conveying meaning to a printer operator. The ink level notifier may be configured to generate notifications via display panel, status illuminators, buzzers, via connected server or computer or other suitable audio and/or visual notifications. In one embodiment, the notification system may be configured to allow a printer operator to select or designate, via the user interface, the manner in which the user wishes to be notified of the low-ink status. For example, a printer operator may select audio notifications, visual notifications, or both. In addition, the notification system may be configured to allow a printer operator to cancel or "turn off" notifications.

As an alternative or in addition to enabling user selection of "low ink" notification set points, the notification system 200 may include an algorithm or routine that is configured to automatically set the "low ink" notification set points. The automatic "low ink" set point selection routine may be provided as a selectable option in the user interface. When selected by a printer operator, the routine may be configured to forecast a reasonable "low ink" notification set points based on any number of factors including, for example, ink usage history for the ink channels, types of jobs printed, number of pages printed, etc. The automatic notification set point routine may continuously vary the determined "low ink" notification set point or may update at set points at any suitable time/print increments.

Figure 6A:
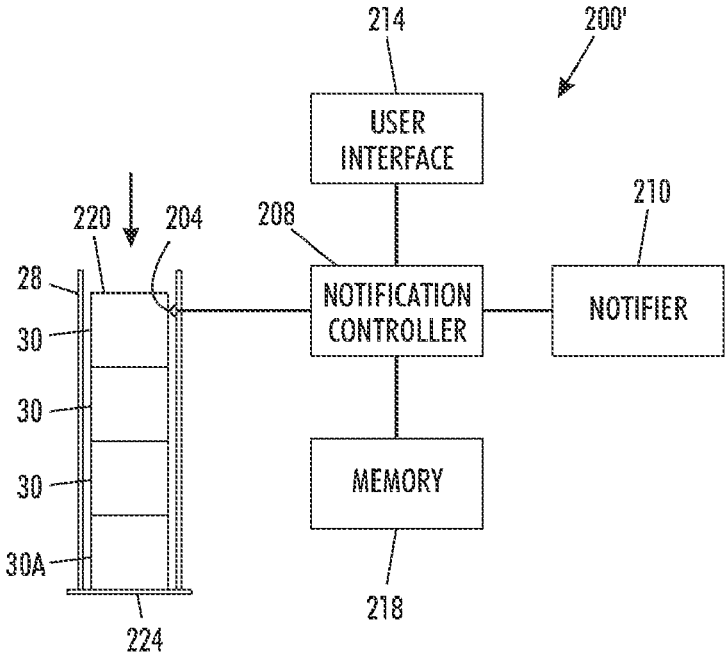
FIG. 6*a* is a schematic block diagram of an embodiment of a user adaptable ink status conveyance system for use with the phase change ink imaging device of FIG. 1.

As mentioned, the notification controller in conjunction with the ink level sensors is configured to maintain a measure or estimate of the available ink volume in each ink feed channel between a maximum monitored ink level and an "ink out" level. FIG. 6*a* depicts an embodiment of the user adaptable ink level notification system 200' that may be utilized with the phase change ink imaging device described above. As depicted in FIG. 6*a*, each feed channel 28 may be provided with a maximum monitored ink level sensor 204 that is positioned along the feed channel path to detect when the end 220 of a column of ink, i.e., the abutted length of ink sticks, in the feed channel 28 has reached or passed the sensor position 204 on its way toward the melt end of the feed channel.

Ink feed channels 28 are typically configured to accommodate multiple ink sticks. Ink sticks are inserted at the insertion end and are transported along the feed path of the feed channel toward the melt end 224 of the channel. The ink sticks may be urged along by a pusher, feed belt, gravity, or other means. When a feed channel is substantially empty of ink sticks, the first ink stick 30A that is inserted is transported until it reaches the melt end 224 of the feed channel. Subsequently inserted ink sticks 30 are transported until they make contact with the previously inserted ink sticks. Accordingly, the abutted length of ink sticks corresponds substantially to a column of solid ink in each feed channel. Tight manufacturing tolerances for the ink sticks ensure that the ink sticks are substantially identical in mass and shape. Therefore, in one embodiment, the amount of available ink in a feed channel may be correlated to the length of the column of ink, i.e., abutted ink sticks in the feed channels, or the distance between the front surface of the first ink stick in the feed channel and the trailing surface of the last ink stick in the channel.

In one embodiment, the maximum monitored ink level sensors 204 are positioned along the feed channel paths in an area where it is reasonably certain that the ink sticks abut in the feed channel to form the column of ink. In this embodiment, the maximum monitored ink level corresponds substantially to the distance that the maximum monitored ink level sensor is positioned along the feed channel from the melt end of the channel. In previously known systems, a "low ink" sensor was positioned fairly near to the location where ink volume in a feed channel would be declared "Out" for the channel. This "Out" position is usually at or adjacent the melt end or melt plate in the feed channels Accordingly, previously known "low ink" sensors were positioned fairly close to the melt end of the channel thereby providing a relatively short distance between the "Low" and "Out" states. In these previously known systems, the ink that is available in a feed channel between the "Low" point and the "Out" point would permit approximately 250 to 500 pages to be printed. In contrast, the maximum monitored ink level sensors 204 of the present disclosure may be positioned considerably further away from the "link out" position of the channel, i.e., the melt end or melt plate. In one embodiment, the positioning of the maximum monitored ink level sensor in a feed channel may allow the printing of approximately 2000 or more pages (based on predetermined ink per page values or ink per page estimates) once the end of the column of ink has been detected by the sensor. The maximum monitored ink level sensors, however, may be placed in any suitable position along the feed channel.

The maximum monitored ink level sensor 204 is configured to detect or sense when the end of the column of ink reaches or passes by the sensor position in the feed channel. The sensors may comprise mechanically settable flags, optical sensors, or any suitable type of sensor. A continuously variable sensor output value based on the ink column length or the position of an urging device may also be utilized where the maximum monitored ink level would correspond to a sensor value, such as voltage level or resistance value, within the range of variation based on column length, mass or similar volume state. The sensors may be configured to generate signals in response to detecting the presence of the end of the column of ink sticks or in response to detecting the absence of ink as the end of the column of ink passes by the sensor. Ink sticks may include sensor features for interacting with the maximum monitored ink level sensors to facilitate detection of the end of the column of ink. Ink stick sensor features may comprise indentations or protrusions that are placed in predetermined positions on the ink stick body that enables the sensor features to appropriately interact with the sensors in the feed channel.

The maximum monitored ink level sensor 204 is configured to generate a "start monitoring" signal indicating that the end 220 of the column of ink or the trailing surface of the last ink stick inserted into the feed channel has reached or passed by the sensor position 204 or reached the pertinent remaining ink volume column length in the feed channel. The notification controller 208 is configured to receive the "start monitoring" signal from the respective sensors. In response to receiving a "start monitoring" signal from a sensor (sensor influenced condition interpreted by the controller to be equivalent to the designated signal value or transition state), the notification controller 208 is configured to set an available ink volume value for the channel to the maximum monitored ink level. Thereafter, the notification controller is configured to monitor or track ink consumption for the feed channel and to update or adjust the available ink volume values accordingly. Ink consumption may be tracked in any suitable manner. For example, many printers are configured to count the number of ink drops ejected from the printheads during printing and maintenance operations. Alternatively, the printer may be configured to count active pixels in image data, i.e., image pixels that are to receive drops of ink. The ink drop count or pixel count information may be made readily available to the notification controller. Information regarding the average size of a drop of ink for a particular printhead may be stored in the memory 218 or otherwise be made accessible to the notification controller. Ink consumption for a channel may then be determined by the product of the number of drops ejected and the drop weight or drop volume. This amount may then be subtracted from the available ink volume value for a channel.

Thus, in one embodiment, the notification controller 208 is configured to continually maintain an available ink volume value for each ink channel in which the end column of ink has reached or passed the maximum monitored ink level sensor. The available ink volume values may be maintained by the notification controller until ink stick insertions cause the end of the column of ink to once again extend toward the insertion area beyond the maximum monitored ink level sensor indicating that the ink channel has more than the maximum monitored ink level therein.

In another embodiment, the notification controller may be configured to monitor available ink volumes by counting the number of ink sticks that pass a predetermined point in the feed channel. Each time an ink stick is detected or passes by an ink level sensor in the channel, the notification controller is configured to add an amount corresponding to an ink stick volume to the available ink volume value for the feed channel. Ink consumption may be tracked as described above by counting ink drops ejected or active pixels in image data. The ink consumption amounts may then be subtracted from the available ink volume values for the channel. This method may be useful when a printer operator inserts only a minimal amount of ink, or number of ink sticks, into an ink channel, such that the column of ink may not extend all the way to a maximum monitored ink level position in the ink channel. The previously mentioned sensing method using a continuously variable sense system offers another means of determining the remaining ink volume. Continuous in this instance may include a constantly varying value or a series of intermittent value steps.

Figure 7:
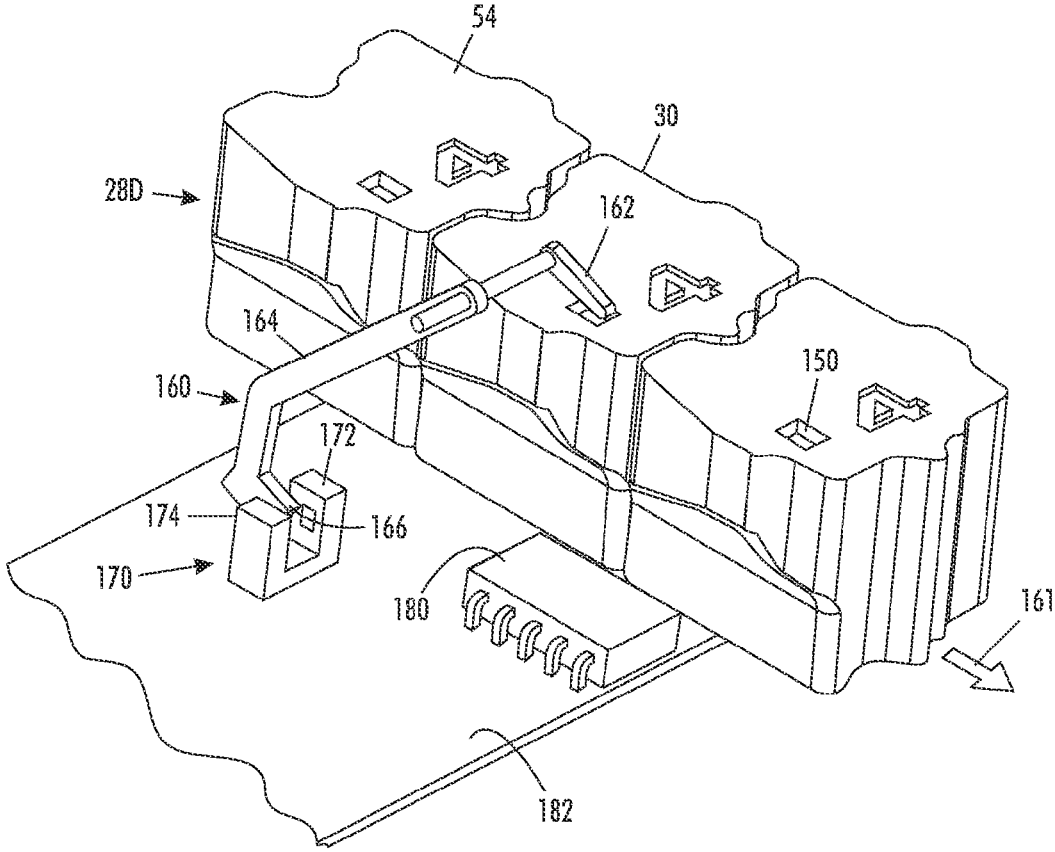
FIG. 7 shows an embodiment of a sensor system for detecting ink sticks in a feed channel.

FIG. 7 shows an embodiment of an ink level sensor that may be used to detect the end of a column of ink in a feed channel as well as to count the number of ink sticks that pass the sensor position in the feed channel. In the embodiment of FIG. 7, the sensor includes a movable detector element that includes a finger 162 attached to a pivoting arm 164. One end of the arm 164 includes a flag 166 that engages a detector, such as an opto-sensor 170. The ink stick includes a sensing element 150 that comprises a feature formed in an external surface of the ink stick. In this embodiment, the sensing element 150 is formed in the top surface of the ink stick. Ink sticks may have elements formed in external sides of the ink stick body when the ink stick body is molded into its shape. The finger 162 and the arm 164 are fixed to one another to move as a unit about a fixed pivot point 165.

As the ink sticks progress in the feed direction 161 along the feed channel 28D, the distal end of the finger 162 of the feed channel counting mechanism 160 slidingly engages the surface of the ink sticks. When an ink stick sensing element 150 passes the distal end, or tip, of the finger 162, the finger enters the sensing element, and the finger 162 and arm 164 of the counting mechanism pivot about the pivot point 165, causing a sensor, in this example the opto-sensor 170, to detect that another ink stick is passing the counting mechanism. In this embodiment, the notification controller is operably coupled to the opto-sensor 170. The notification controller maintains a count of the number of times that the opto-sensor detects that the arm has moved to indicate that another ink stick has passed the counter.

As the end of the last ink stick passes the distal tip of the finger 162, the counter arm 160 moves into a third position. As an example, the third position is rotated further counter-clockwise from the second position. A second sensor may detect that the counter arm 160 is in its third position. For example, a second opto-sensor 177 may detect the flag 166 when the counter arm is in its third position by being positioned so that the flag interrupts the beam of light of the second opto-sensor. The notification controller may be operably connected to the second opto-sensor to receive a signal when the flag interrupts the beam of light of the second opto-sensor indicating that the end of the column of ink has passed the flag at which point the notification controller is configured to set the available ink volume for the channel to a predetermined value, e.g. the ample or maximum monitored ink level. Alternatively, for the example above, an amount of ink volume used, based on pixel count or other means, without seeing an additional sensor transition would indicate that the end of the ink column has passed the sensor and the remaining ink volume could be easily calculated by the method previously described.

Any suitable method or device may be used to determine the available ink volume levels for each feed channel. For example, in embodiments in which ink sticks are moved along a feed channel by a push block or similar device, ink column length may be correlated to the position of the push block in the feed channel. In some embodiments, multiple sensors may be used at multiple positions in the feed channels to detect or monitor the length of an ink column over all or a portion of its length.

Although the embodiments above have been described in conjunction with phase change ink-jet printers, the teachings may be readily applied to other types of imaging devices such as, for example, copiers, plotters, facsimile machines, thermal inkjet printers, etc. In addition, the illustrated embodiments may be incorporated in systems that utilize marking materials other than the phase change inks described above, such as, for example, aqueous inks, oil based inks, etc. Those skilled in the art will recognize that numerous modifications can be made to the specific implementations of the user interface and ink level sensing system described above. Therefore, the following claims are not to be limited to the specific embodiments illustrated and described above. The claims, as originally presented and as they may be amended, encompass variations, alternatives, modifications, improvements, equivalents, and substantial equivalents of the embodiments and teachings disclosed herein, including those that are presently unforeseen or unappreciated, and that, for example, may arise from applicants/patentees and others.

What is claimed is:

1. A phase change ink imaging device comprising:

a printhead configured to eject melted phase change ink onto an image receiver;

an ink source configured to hold a supply of solid phase change ink for the printhead and to deliver the solid phase change ink to an ink melter for melting the solid phase change ink and delivering the melted phase change ink to the printhead;

an ink level sensor configured to generate a signal in response to an available amount of solid phase change ink in the ink source corresponding to an ample ink level;

a user interface configured to enable a user to designate a low ink notification set point for use with the ink source;

a controller operatively connected to the ink level sensor to receive the signal from the ink level sensor and operatively connected to the user interface to receive the user designated low ink notification set point from the user interface, the controller being configured to determine an available ink volume in the ink source between the ample ink level and an ink out level and to compare the user designated low ink notification set point to the available ink volume, the controller being configured to generate a low ink signal in response to the available ink volume value being less than the user designated low ink notification set point.

2. The ink jet imaging device of claim 1, the ink source further comprising:

an ink channel configured to receive solid ink sticks at an insertion end of the ink channel and to move the solid ink sticks to a melt end for melting and delivery to the printhead, the solid ink sticks being configured to abut against each other in a region extending from the melt end of the ink channel to form a solid ink column, the ink level sensor providing a signal corresponding to a trailing end of the solid ink column in the ink channel.

3. The ink jet imaging device of claim 2, the ink source further comprising:

a plurality of ink channels, each ink channel being configured with an ink level sensor, each ink level sensor being configured to generate a signal in response to detection of a trailing end of a solid ink column in the ink channel configured with the ink level sensor as the trailing end of the solid ink column reaches a predetermined position in the channel.

4. The ink jet imaging device of claim 3, the user interface being configured to enable a user to designate a low ink notification set point for use with each ink channel.

5. The ink jet imaging device of claim 4, the controller being configured to determine an available ink volume for each ink channel and to compare the user designated low ink notification set point for each ink channel to the corresponding available ink volume for each ink channel, and to generate a low ink signal for each ink channel in which the available ink volume value is less than the user designated low ink notification set point.

6. The ink jet imaging device of claim 5 the controller being configured to compare a default low ink notification set point to the available ink volume for each ink channel for which no user designated low ink notification set point has been received and to generate a low ink signal for each ink channel in which the available ink volume value is less than the default low ink notification set point.

7. The ink jet imaging device of claim 1 wherein the user designated low ink set point corresponds to an approximate number of pages that can be printed using the ink source after the low ink signal is generated.

8. The ink jet imaging device of claim 1 wherein the user designated low ink set point corresponds to an approximate number of full or partial ink sticks remaining in the ink source at which the low ink signal is generated.

9. The ink jet imaging device of claim 4 wherein at least one of the low ink notification set points is different than the low ink notification set points for the other ink channels.

* * * * *

UNITED STATES PATENT AND TRADEMARK OFFICE

CERTIFICATE OF CORRECTION

PATENT NO. : 8,132,877 B2
APPLICATION NO. : 12/183101
DATED : March 13, 2012
INVENTOR(S) : Christopher Ryan Gold et al.

It is certified that error appears in the above-identified patent and that said Letters Patent is hereby corrected as shown below:

On Title Page Item (75) Inventors:

Please delete "Frederck T. Mattern" and insert --Frederick T. Mattern-- in its place.

Signed and Sealed this
Twenty-fifth Day of June, 2013

Teresa Stanek Rea
*Acting Director of the United States Patent and Trademark Office*